US007967640B2

(12) United States Patent
Hashimoto et al.

(10) Patent No.: US 7,967,640 B2
(45) Date of Patent: Jun. 28, 2011

(54) CARD CONNECTOR WITH A BOTTOM WALL WITH ISOSCELES TRIANGLE SHAPED CONTACTS

(75) Inventors: Kazuya Hashimoto, Yokohama (JP); Yosuke Takai, Sakura (JP); Taro Ishii, Yokohama (JP)

(73) Assignees: Yamaichi Electronics Co., Ltd., Tokyo (JP); Sony Ericsson Mobile Communications Japan, Inc., Tokyo (JP)

( * ) Notice: Subject to any disclaimer, the term of this patent is extended or adjusted under 35 U.S.C. 154(b) by 0 days.

(21) Appl. No.: 12/684,462

(22) Filed: Jan. 8, 2010

(65) Prior Publication Data

US 2010/0178807 A1 Jul. 15, 2010

(30) Foreign Application Priority Data

Jan. 9, 2009 (JP) ..... 2009-003578

(51) Int. Cl.
*H01R 24/00* (2006.01)

(52) U.S. Cl. ..... 439/630

(58) Field of Classification Search ..... 439/630, 439/632, 326, 74, 76.1
See application file for complete search history.

(56) References Cited

U.S. PATENT DOCUMENTS

| | | | | |
|---|---|---|---|---|
| 6,132,229 | A * | 10/2000 | Wu | 439/188 |
| 6,234,810 | B1 * | 5/2001 | Schnell et al. | 439/76.1 |
| 6,786,748 | B2 * | 9/2004 | Masson et al. | 439/188 |
| 6,843,688 | B2 | 1/2005 | Matsunaga et al. | |
| 7,361,037 | B2 | 4/2008 | Kanazawa | |
| 7,371,079 | B2 * | 5/2008 | Yang et al. | 439/74 |
| 7,384,294 | B2 * | 6/2008 | Washino et al. | 439/326 |
| 7,481,686 | B2 | 1/2009 | Uchida et al. | |
| 2001/0034162 | A1 * | 10/2001 | Annaler et al. | 439/630 |

FOREIGN PATENT DOCUMENTS

| | | |
|---|---|---|
| JP | 3595939 | 9/2004 |
| JP | 2007-149394 | 6/2007 |
| JP | 2007-234472 | 9/2007 |
| JP | 2008-97947 | 4/2008 |
| JP | A 2008-108455 | 5/2008 |
| JP | A 2009-295496 | 12/2009 |
| JP | A 2010-135137 | 6/2010 |

OTHER PUBLICATIONS

Official Notice of Rejection issued in Japanese Patent Application No. 2009-003578; mailed Oct. 29, 2010; with English-language translation.

* cited by examiner

*Primary Examiner* — Chandrika Prasad
(74) *Attorney, Agent, or Firm* — Oliff & Berridge, PLC

(57) ABSTRACT

A card connector according to the present invention includes a bottom wall of a base member configured to support a plurality of contacts in a cantilever manner. A rectangular SIM card is inserted into the card connector in such a manner that the shorter side of the card is parallel to the direction of insertion. The plurality of contacts of the card connector are arranged to correspond to respective plural external contact points of the SIM card. Each of the contacts includes a contact portion, two elastic deformation portions, and a terminal portion. The two elastic deformation portions of the contact are coupled together so as to substantially form an isosceles triangle shape with a vertex angle $\theta_1$ at a vertex corresponding to the contact portion. The plurality of contacts are arranged parallel to one another, each in an inverted V shape with respect to the card insertion direction.

6 Claims, 6 Drawing Sheets

CARD CONNECTOR WITH A BOTTOM WALL WITH ISOSCELES TRIANGLE SHAPED CONTACTS

CROSS-REFERENCE TO RELATED APPLICATIONS

This application claims the benefit of Japanese Patent Application No. 2009-003578, filed Jan. 9, 2009, which is hereby incorporated by reference herein in its entirety.

BACKGROUND OF THE INVENTION

1. Field of the Invention

The present invention relates to a card connector, and more specifically, to a card connector of a type in which a rectangular SIM (Subscriber Identify Module) card is inserted such that the shorter side of the card is approximately parallel to the direction of insertion.

2. Description of the Related Art

Various cards with built-in integrated circuits (hereinafter referred to as "IC cards") have been used in electronic apparatuses such as cellular phones in order to expand their functions. Such a conventional IC card is normally installed in an electronic apparatus via a card connector. The IC card connector includes a plurality of contacts configured to electrically connect the IC card to the electronic apparatus. Each of the contacts is shaped like an elongated plate. One end of the contact is fixed to the connector, and the other end is free; the contact is supported in a cantilever manner. The contacts are arranged parallel to one another. The IC card is normally inserted along the direction in which the contacts are arranged parallel to one another. Furthermore, in the case where the IC card is shaped like a rectangle in which the width is shorter than the length (such an IC card is hereinafter referred to as a rectangular IC card), the IC card is normally often inserted into the card connector such that the longer side of the IC card is approximately parallel to the direction of insertion ("short side insertion").

In recent years, the reduced sizes of electronic apparatuses have resulted in a change in the installation position of the IC card connector. This has forced the insertion orientation of the IC card to be changed from that wherein the longer side of the IC card is approximately parallel to the direction of insertion to that wherein the shorter side of the IC card is approximately parallel to the direction of insertion ("long side insertion"). To deal with this change in insertion orientation, an IC card connector has been proposed in which a plurality of contacts are arranged so as to incline with respect to the insertion direction of the card, as disclosed in Japanese Patent Laid-Open No. 2007-149394.

The card connector disclosed in Japanese Patent Laid-Open No. 2007-149394 is configured such that the contacts are inclined with respect to the insertion direction of the card to allow the IC card to be inserted such that either the longer or shorter side of the card may be approximately parallel to the direction of insertion. That is, the contacts are inclined with respect to the insertion direction of the card to allow the IC card to be smoothly inserted into the electronic apparatus without being caught on any of the contacts, regardless of whether the IC card is inserted with the longer or shorter side approximately parallel to the direction of insertion.

However, when the rectangular card needs to be inserted such that the shorter side of the card is approximately parallel to the direction of insertion, the card may be incorrectly inserted into the card connector such that the longer side of the card is approximately parallel to the direction of insertion (see FIG. 4). When an IC card having a conventional structure is thus incorrectly inserted, the corners of the rectangular IC card may come into abutting contact with a terminal portion of a contact serving as a free end, causing the contact to become deformed or buckled.

To avoid abutting contact of a corners of the IC card with the free end of the contact, for example, the free end of the contact may be hidden inside a base board of the card connector in which the contacts are supported. In this case, the height of the contacts needs to be increased in order to ensure the required contact pressure. This is opposed to the recent trend of reducing the height of the card connector. Furthermore, the structure of the card connector, particularly of the contacts becomes more complex.

An object of the present invention is to provide a card connector of a type in which an SIM card is inserted into the card connector such that the shorter side of the card is approximately parallel to the insertion direction, the card connector allowing for a reduction in height and simple configuration, and adapted to prevent the contacts from being damaged even when the SIM card, a rectangular IC card, is incorrectly inserted.

SUMMARY OF THE INVENTION

To accomplish the above object, a card connector according to the present invention is configured as follows.

The present invention provides a card connector having a bottom wall of a base member configured to support a plurality of contacts in a cantilever manner, wherein a rectangular SIM card is inserted into the card connector in such a manner that a shorter side of the card is approximately parallel to the insertion direction. The plurality of contacts of the card connector are arranged to correspond to respective plural external contact points of the SIM card. Each of the contacts has a contact portion configured to come into contact with a pad of the SIM card, two elastic deformation portions configured to enable the contact portion to be elastically displaced up and down, and a terminal portion a part of which is fixed to a bottom wall and a remaining part of which is connected to an external contact point of an electronic apparatus in which the card connector is installed. The two elastic deformation portions of the contact are coupled together so as to substantially form an isosceles triangle shape with a vertex angle $\theta_1$ at a vertex corresponding to the contact portion. The plurality of contacts are arranged parallel to one another in such a manner that each contact is in an inverted V shape with respect to the card insertion direction.

The present invention also provides a card connector having a bottom wall of a base member configured to support a plurality of contacts in a cantilever manner, wherein a rectangular SIM card is inserted into the card connector in such a manner that a shorter side of the card is approximately parallel to the insertion direction. The plurality of contacts of the card connector are arranged to correspond to respective plural external contact points of the SIM card. Each of the contacts has a contact portion configured to come into contact with a pad of the SIM card, a substantially isosceles triangular shaped elastic deformation portion configured to enable the contact portion to be elastically displaced up and down, and a terminal portion a part of which is fixed to the bottom wall and a remaining part of which is connected to an external contact point of an electronic apparatus in which the card connector is installed. The substantially isosceles triangular shaped elastic deformation portion has a vertex angle $\theta_1$ at a vertex corresponding to the contact portion. The plurality of contacts are arranged parallel to one another in such a manner that each of the contacts is in an inverted V shape with respect to the card insertion direction.

In the card connector according to the present invention, each of the contacts is such that the two substantially isosceles triangular shaped elastic deformation portions form a vertex angle $\theta_1$ at the vertex corresponding to the contact portion. Alternatively, the contact includes the substantially isosceles triangular shaped elastic deformation portion having the vertex angle $\theta_1$ at the vertex corresponding to the contact portion. Thus, the contacts can be inhibited from being deformed by the incorrectly inserted SIM card regardless of the simple structure of the contacts. Furthermore, the appropriate setting of the vertical angle $\theta_1$ enables the contacts to be prevented from being deformed. Moreover, the contacts can be fixedly supported on the base member in a cantilever manner as in the conventional art. The card connector according to the present invention allows for a reduction in height.

Further features of the present invention will become apparent from the following description of exemplary embodiments (with reference to the attached drawings).

DESCRIPTION OF THE EMBODIMENTS

An embodiment of a card connector according to the present invention will be described below with reference to FIGS. 1 to 6.

Figure 1A:
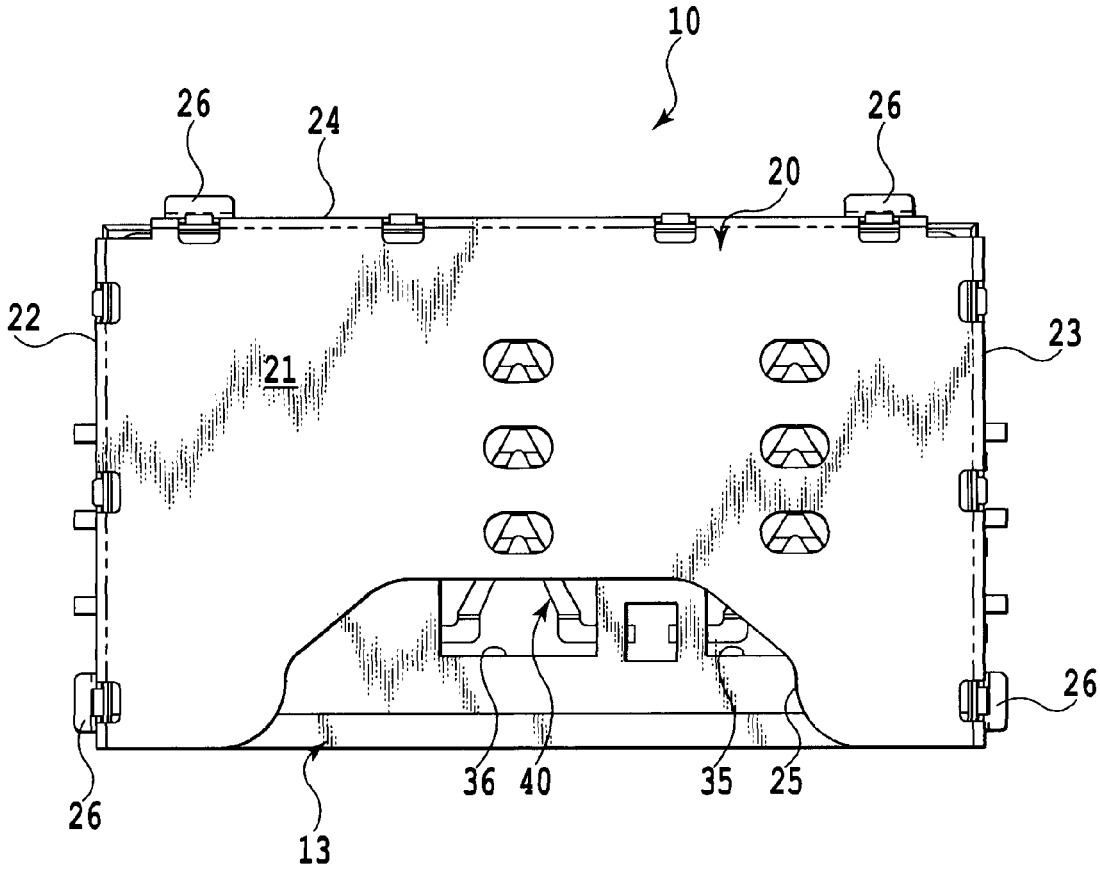
FIG. 1A is a top view of an embodiment of a card connector according to the present invention.
Figure 1B:
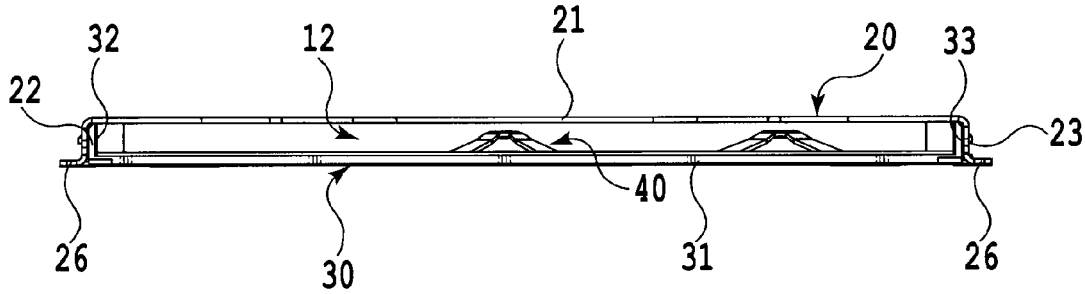
FIG. 1B is a front view of the card connector in FIG. 1A.
Figure 2:
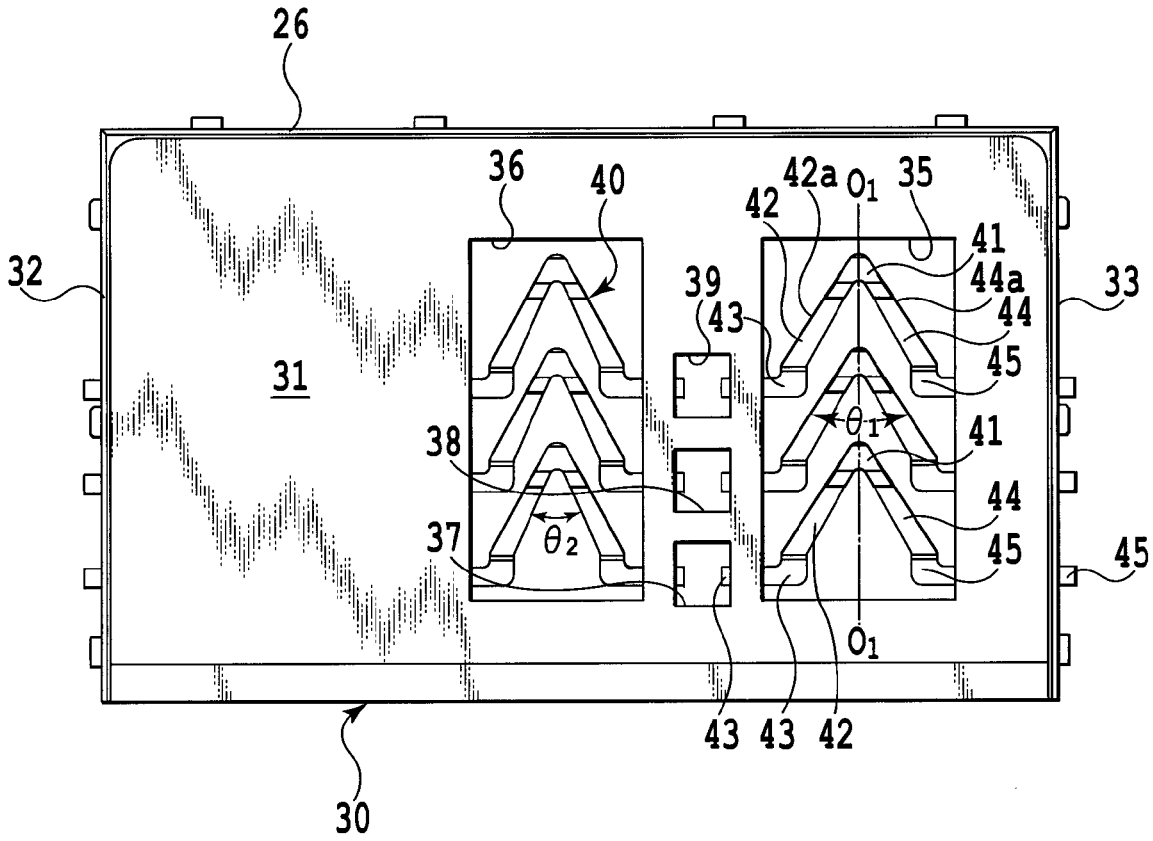
FIG. 2 is a top view of the card connector shown in FIG. 1A and from which a cover member has been removed.
Figure 3B:
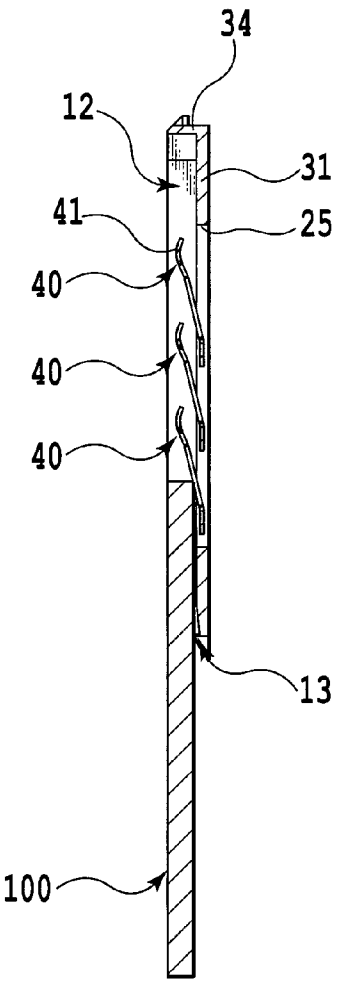
FIG. 3B is a sectional view of the card connector shown in FIG. 3A, the sectional view being taken along line III-III in FIG. 3A.
Figure 3A:
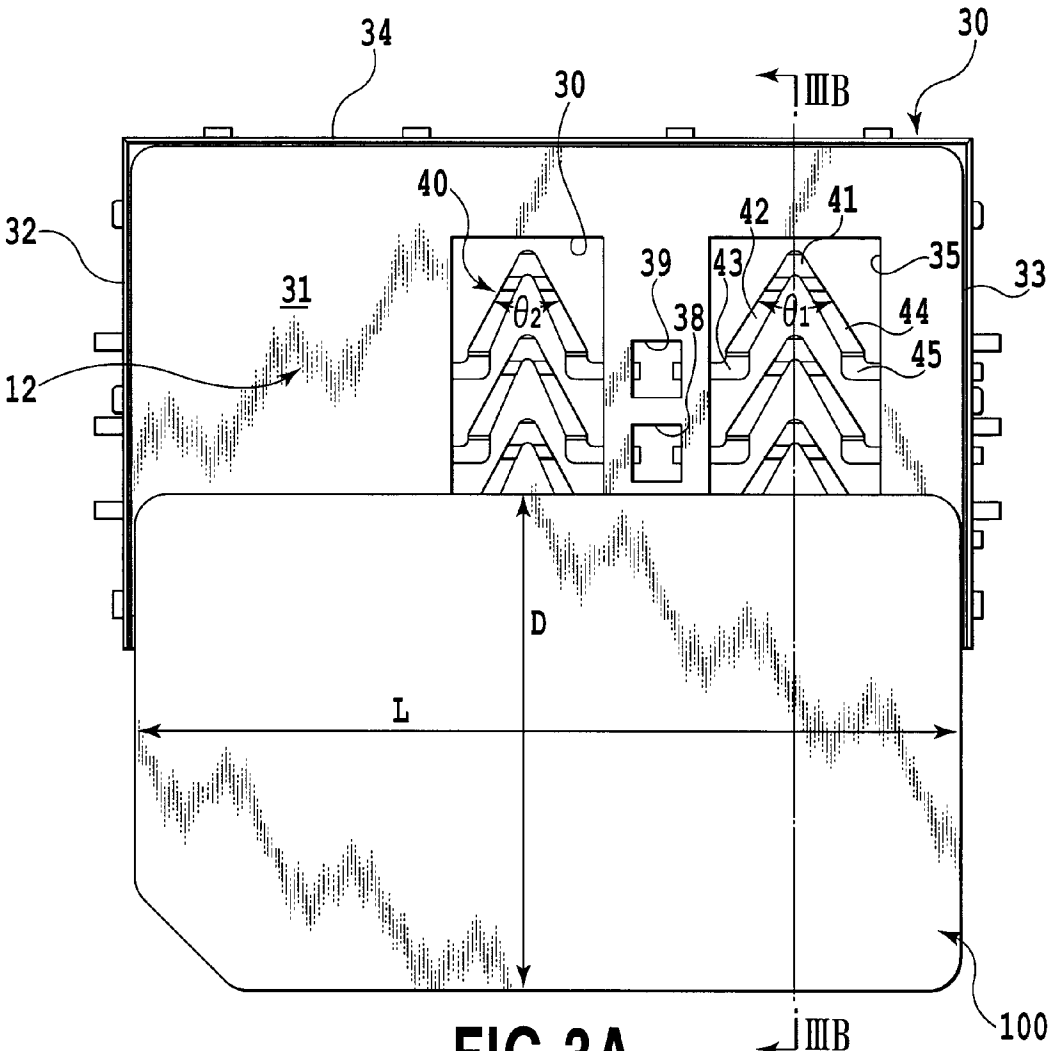
FIG. 3A is top view of the card connector shown in FIG. 2 and in which a SIM card has been correctly installed in the card connector.
Figure 4:
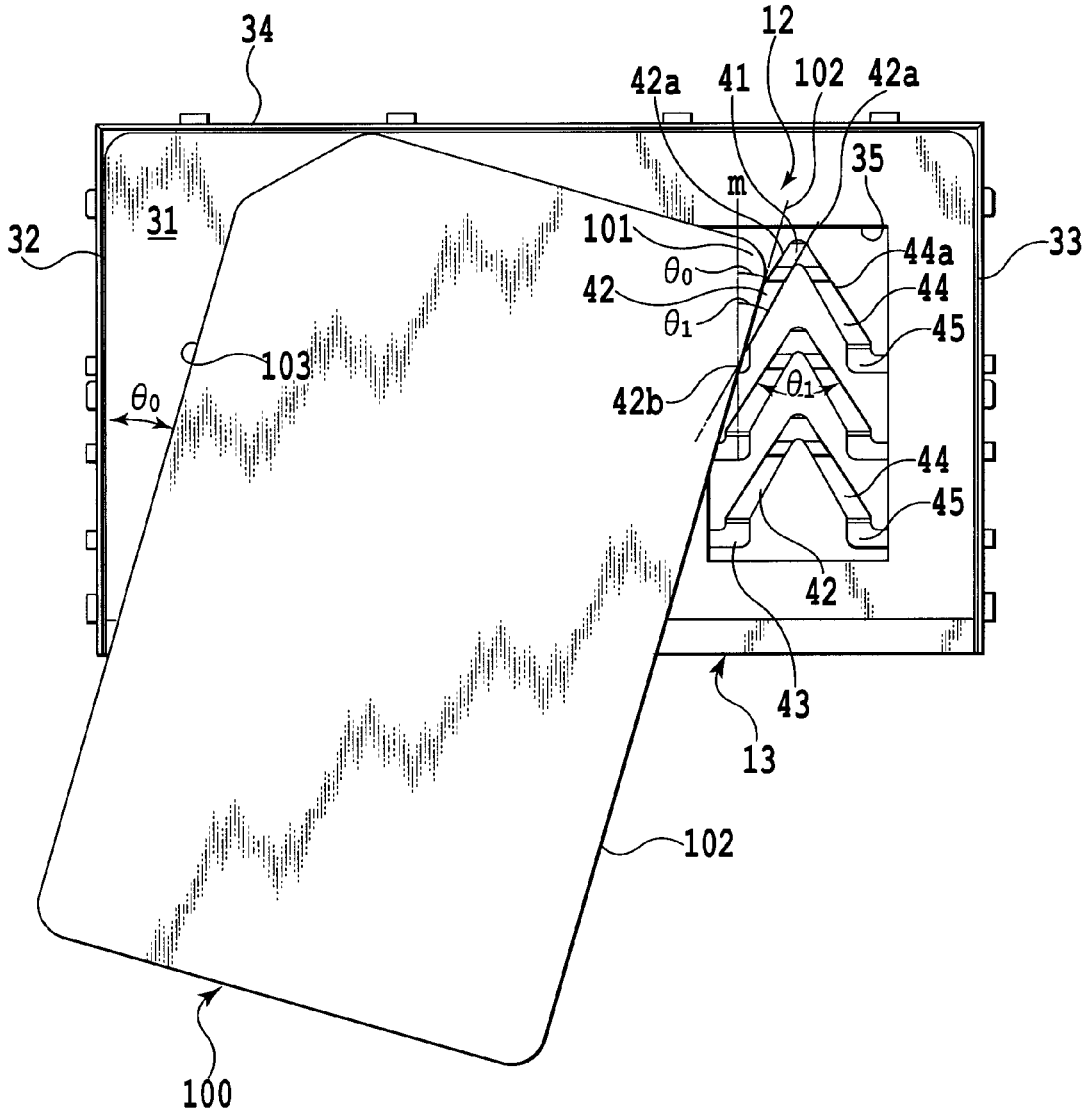
FIG. 4 is a diagram showing that the SIM card has been incorrectly installed in the card connector shown in FIG. 2.
Figure 5A:
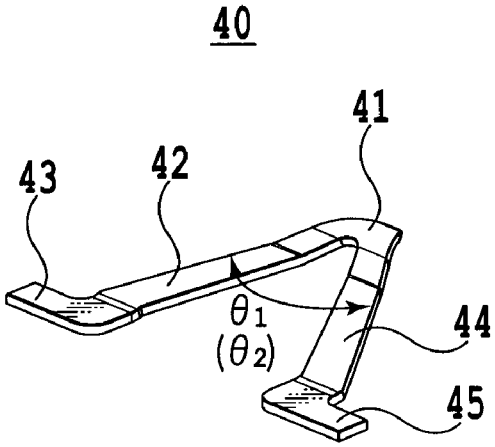
FIG. 5A is a perspective view of an embodiment of a contact used in the card connector according to the present invention.
Figure 5B:
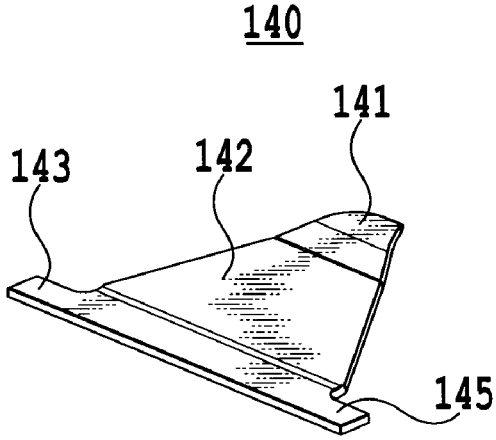
FIG. 5B is a perspective view of another embodiment of the contact used in the card connector according to the present invention.
Figure 6:
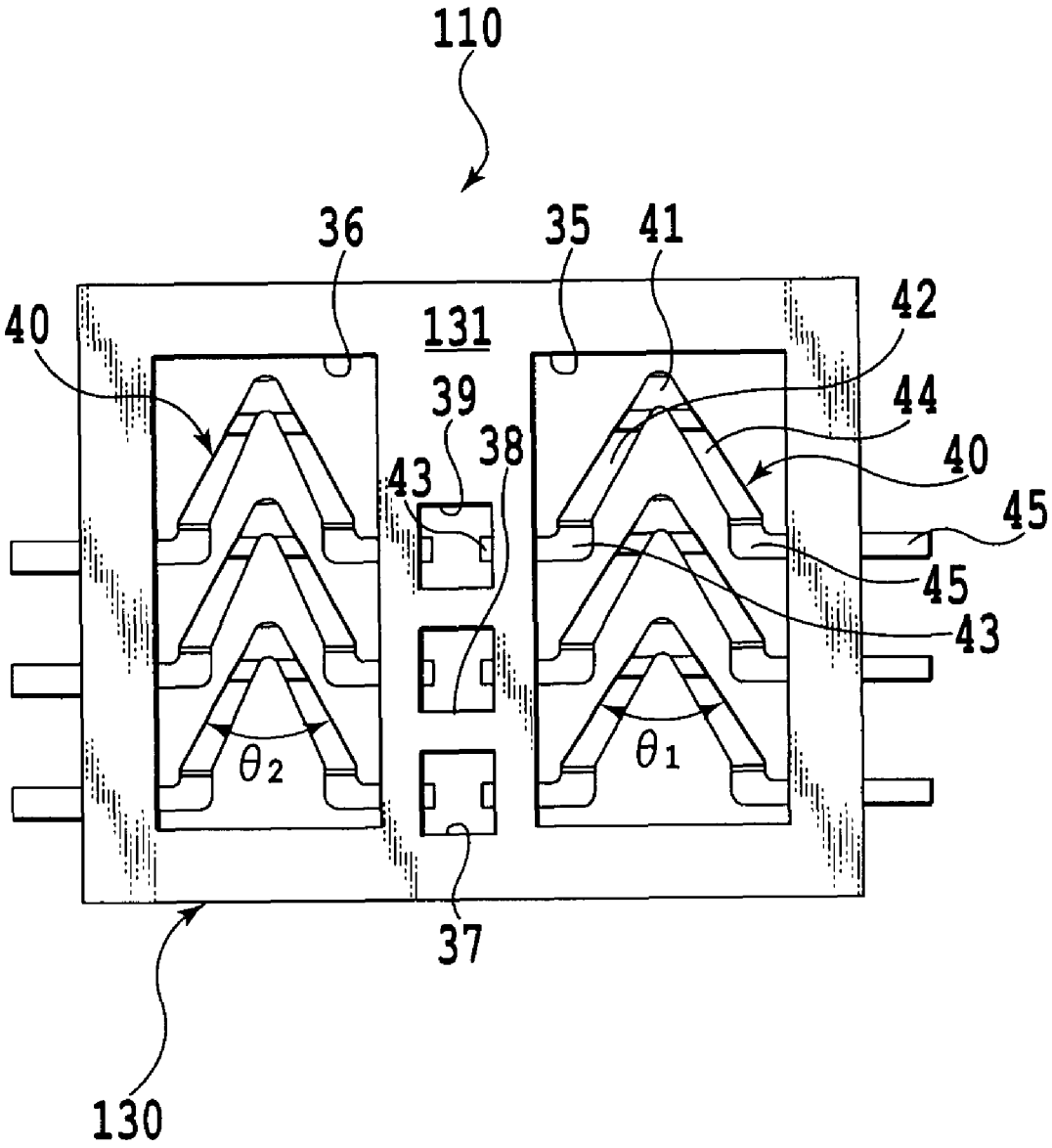
FIG. 6 is a top view of another embodiment of the card connector according to the present invention.

FIGS. 1A and 1B show an embodiment of a card connector according to the present invention. FIG. 1A is a top view, and FIG. 1B is a front view. FIG. 2 is a top view of the card connector shown in FIG. 1A and from which a cover member has been removed. FIGS. 3A and 3B are diagrams showing that a SIM card has been correctly installed in the card connector shown in FIG. 2. FIG. 3A is a top view, and FIG. 3B is a sectional view of the card connector shown in FIG. 3A, the sectional view being taken along line in FIG. 3A. FIG. 4 is a diagram showing that the SIM card has been incorrectly installed in the card connector shown in FIG. 2. FIGS. 5A and 5B show embodiments of a contact used in the card connector according to the present invention. FIG. 5A shows an embodiment of the contact. FIG. 5B shows another embodiment of the contact. FIG. 6 is a top view of another embodiment of the card connector according to the present invention.

Embodiment 1

First, a SIM card 100 inserted into a card connector according to the present embodiment (hereinafter simply referred to as a "connector") will be described in brief. As for the SIM card 100 of the present embodiment, as shown in FIGS. 3A, 3B, and 4, the length in the longitudinal direction (the left-right direction of FIG. 3A) is defined as L, the length in the transverse direction (the up-down direction of FIG. 3A) is defined as D, and the SIM card 100 has a rectangular, flat shape in which L>D. The SIM card 100 of FIG. 3A, according to the present embodiment includes a plurality of (in the present embodiment, six) pads (not shown) located on the back surface thereof and serving as external contact points.

As shown in FIGS. 1A, 1B, and 2, a card connector 10 according to a first embodiment of the present invention generally comprises a cover member 20, a base member 30, and a plurality of contacts 40.

The cover member 20 is laid on the base member 30 to form a box-like card accommodation space 12 into which the SIM card 100 (FIG. 3A) can be installed. The cover member 20 comprises a generally rectangular top plate 21, and a first sidewall 22, a second sidewall 23, and a third sidewall 24 extending from three sides of the rectangular top plate 21 orthogonally to the top plate 21. The cover member 20 is open on the lower side thereof in FIGS. 1A and 1B. The top plate 21 of the cover member 20 includes a cutout recessed portion 25 in a card insertion port 13 into which the SIM card 100 is inserted. Furthermore, to allow the assembled connector 10 to be fixed to an electronic apparatus by soldering or the like, a plurality of (in the present embodiment, four) fixing pieces 26 are provided at predetermined positions on the first to third sidewalls 22, 23, and 24.

The base member 30 includes a generally rectangular bottom wall 31, and a first sidewall 32, a second sidewall 33, and a third sidewall 34 extending from three sides of the rectangular bottom wall 31 orthogonally to the bottom wall 31. When assembled into a connector 10, the first to third sidewalls 32, 33, and 34 of the base member 30 are laid on the first to third sidewalls 22, 23, and 24, respectively, of the cover member 20 to form a box-shaped card accommodation space 12 as shown in FIG. 1B and the card insertion port 13 on the lower side as shown in FIG. 1A. That is, the connector 10 of present embodiment is configured such that the rectangular SIM card 100 is inserted such that the shorter side of the card 100 is approximately parallel to the insertion direction.

Generally rectangular openings 35 and 36, having a plurality of contacts 40 (described below) arranged therein, are formed in the base member 30. In the present embodiment, as distinctly shown in FIG. 2, the thin, rectangular first and second openings 35 and 36 extend parallel to each other in the up-down direction of FIG. 2, corresponding to the alignment of the plurality of pads of the inserted SIM card 100. As shown in FIG. 2, the first opening 35 is located close to the right-sided second sidewall 33, and the second opening 36 is located on the left close to the center of FIG. 2. The longitudinal center line of each of the first and second openings 35 and 36 (only the center line $O_1$-$O_1$ of the first opening 35 is shown) is parallel to the first sidewall 32 and the second sidewall 33. That is, the longitudinal center line of each of the first and second openings 35 and 36 ($O_1$-$O_1$) is parallel to the card insertion direction. In the present embodiment, three contacts 40 are arranged in each of the first and second openings 35 and 36. Three window portions 37, 38, and 39 are provided between the first opening 35 and the second opening 36. One terminal portion of each of the contacts 40 is located in one of the corresponding window portions 37, 38, and 39.

The plurality of contacts 40 electrically connect the SIM card 100 inserted into the connector 10, to the electronic apparatus (not shown in the drawings), in which the connector 1 is mounted. More specifically, the contacts 40 connect the pads of the SIM card 100, which correspond to external contact points, to external contact points of the electronic apparatus. Each of the plurality of contacts 40 is formed of a thin, conductive metal plate by press working.

In the present embodiment, as shown in FIGS. 2 and 5A, each of the contacts 40 comprises a contact portion 41, two elastic deformation portions 42 and 44, and two terminal portions 43 and 45. The contact portion 41 is provided at a crossing portion at which the two elastic deformation portions 42 and 44 are coupled together so that the contact portion 41 serves as a free end of the contact 40 to elastically contact the corresponding pad of the SIM card 100. The contact portion 41 is positioned in the card accommodation space 12. The two elastic deformation portions 42 and 44 have the same length and are coupled to the contact portion 41 so that the outer ridges 42*a* and 44*a* of the elastic deformation portions 42 and 44 form an angle $\theta_1$. The elastic deformation portions 42 and 44 allow the contact portion 41 to be elastically displaced in the up-down direction (the left-right direction in FIG. 3B). It is thus understood that the contact portion 41 is positioned at the vertex of an isosceles triangle formed of the two elastic deformation portions 42 and 44 crossing so as to form the angle $\theta_1$. Thus, although the shape of the contact 40 is not so limited, one can generally say that it appears as an inverted letter V when viewed from the top. The ends of the two elastic deformation portions 42 and 44, which are positioned opposite the contact portion 41, are coupled to respective left and right terminal portions 43 and 45. The two terminal portions 43 and 45 are connected together to the corresponding external contact point of the external apparatus by soldering. However, only one of the terminal portions 43 and 45 need be connected to the external contact point of the electronic apparatus; both terminal portions need not be connected. The terminal portions 43 and 45 are present on an extension of the base of the isosceles triangle formed by the two elastic deformation portions 42 and 44, which cross so as to form the angle $\theta_1$. Portions of the terminal portions 43 and 45 are utilized as a fixation portion to fix the contact 40 to the bottom wall 31 of the base member 30. In the present embodiment, the method for fixing the contact 40 is not limited to this aspect. However, as shown in FIG. 2, the terminal portions 43 and 45 are embedded in the bottom wall 31 by insert molding. Thus, as seen in a sectional view in FIG. 3B, the contact 40 is fixedly supported on the bottom wall 31 of the base member 30 by the terminal portions 43 and 45 in a cantilever manner as seen from the side of the connector.

In the present embodiment, a total of six contacts 40 are arranged parallel to one another in the up-down direction so that the three contacts are arranged in the first opening 35 and the remaining three contacts are arranged in the second opening 36. Specifically, the contacts 40 located in the first opening 35 are arranged so that the contact portions 41 of the contacts 40 are positioned on the longitudinal center line $O_1$-$O_1$ of the first opening 35. The two left and right elastic deformation portions 42 and 44 are arranged with bilateral symmetry with respect to the longitudinal center line $O_1$-$O_1$. Furthermore, the contact portion 41 is positioned towards the rear along the card insertion direction (upward in FIG. 2). A straight line (which is aligned with the extension of the base of the isosceles triangle formed by the two elastic deformation portions 42 and 44 crossing so as to form the above-described angle $\theta_1$) connecting the two left and right terminals portions 43 and 45 continuous with the respective left and right elastic deformation portions 42 and 44, is parallel to the third sidewall 34 of the base member 30. Thus, as shown in FIG. 2, the three contacts 40 located in the first opening 35 are arranged parallel to one another so as to have an inverted V shape with the contact portion 41 positioned at the top position of the shape. The two left and right elastic deformation portions 42 and 44 are difficult to twist when having the same length.

In the present embodiment, for example, the left-handed terminal portion, in FIG. 2, of each of the contacts 40 arranged in the first opening 35 extends so as to project into the window portion 39 formed on the bottom wall 31 of the base member 30. On the other hand, the right-handed terminal portion of each of the contacts 40 extends so as to project outward (rightward in FIG. 2) from the second sidewall 33 of the bottom wall 31.

The three contacts 40 arranged in the second opening 36 are the same as those arranged in the first opening and will thus not be described below.

In the present embodiment, in each of the contacts 40 arranged in the second opening 36, the angle between the two elastic deformation portions 42 and 44 is $O_2$ as shown in FIG. 2. In this case, preferably, $\theta_1 \geqq \theta_2$. This configuration can accommodate a reduction in the pitch of the pads of the SIM card 100. Furthermore, in this configuration, the contacts 40 arranged in the second opening 36 are unlikely to be damaged even when the SIM card 100 is incorrectly inserted into the connector.

The contact 40 according to the present embodiment is as described above. However, the contact 40 may be shaped like the contact 140 shown in FIG. 5B. The contact 140 differs from the contact 40 in that a thin metal plate is present in the V-shaped space between the two elastic deformation portions 42 and 44 of the inverted V-shaped contact 40 and the contact 140 is formed like an isosceles triangle having the vertex angle $\theta_1$ and a contact portion 141 and an elastic deformation portion 142, which are continuous with each other. The contact 140 is the same as the contact 40 in that a contact portion 141 of the contact 140 is located at the vertex of the isosceles triangle and two left and right terminal portions 143 and 145 are present on an extension of the base of the isosceles triangle.

The structure of the connector 10 according to the first embodiment of the present invention has been specifically described together with the variation 140 of the contact 40. Now, with reference to FIGS. 3A, 3B, and 4, description will be given of an operation of inserting the SIM card 100 into the connector 10 and an operation performed by the connector 10 according to the present invention if the SIM card 100 is incorrectly inserted into the connector 10.

FIG. 3A shows that the rectangular SIM card 100 is being correctly inserted into the connector 10 such that the shorter side of the card 100 is parallel to the insertion direction (the up-down direction of FIG. 3A). FIG. 3B is a sectional view taken along line III-III in FIG. 3A (line III-III aligns with the longitudinal center line $O_1$-$O_1$ of the first opening 35).

In FIG. 3A, when pushed upward, the SIM card 100 is completely installed in the card accommodation space 12 in the connector 10. At this time, the plurality of (in the present embodiment, six) contacts 40 come into contact with the respective corresponding pads of the SIM card 100 at a predetermined contact pressure. To allow the SIM card 100 to be removed, the SIM card 100 may be pulled out with a finger placed on the SIM card 100 via the cutout recessed portion 25 in the cover member 20.

For example, as shown in FIG. 4, the user may mistake the SIM card 100 for a well-known type that is inserted into the connector such that the longer side of the card is approximately parallel to the direction of insertion, and mistakenly insert the SIM card 100 into the card accommodation space 12 along the first sidewall 32 of the base member 30. In this case, when the SIM card 100 is rotated clockwise as shown in FIG. 4, if the contacts were of a conventional linear shape and supported on the bottom wall 31 in a cantilever manner as previously described above, a corner 101 of the SIM card 100 may come into abutting contact with the contact portion or elastic deformation portion of a contact. In other cases, the corner 101 of the card 100 may slip under the contact. Then, the contact 40 may be buckled or twisted and may thus be damaged, affecting the subsequent use.

However, as described above, the two elastic deformation portions 42 and 44 of the contact 40 according to the present embodiment are shaped like the inverted letter V so as to form the angle $\theta_1$ ($\theta_2$) at the contact portion 41 corresponding to the vertex. Thus, as shown in FIG. 4, even when the corner 101 of the SIM card 100 comes into abutting contact with the left-sided elastic deformation portion 42, due to its inclination, the buckling, twisting or other deformation force caused by the corner 101 of the SIM card 100 is dispersed. Moreover, if the corner 101 of the SIM card 100 comes into abutting contact with the left-sided elastic deformation portion 42, because it is supported by the right-handed elastic deformation portion 44 for reinforcement, rotation of the SIM card can be inhibited. This also prevents the left-handed elastic deformation portion 42 from being significantly deformed.

Moreover, FIG. 4 shows that the SIM card 100 has been rotated so that the left side 103 of the SIM card 100 forms an angle $\theta_0$ to the first sidewall 32 of the base member 30. FIG. 4 also shows that the right side 102 of the SIM card 100 is in abutting contact with the base 42*b* of the left-handed elastic deformation portion 42, which corresponds to the crossing portion between the left-handed elastic deformation portion 42 and the left-handed terminal portion 43 of the contact 40 located at the uppermost position in the first opening 35. In this state, the adverse effect, on the contacts 40, of pulling out the SIM card 100 incorrectly inserted into the connector 10 is expected to be worst. But again, even in the worst case, due to the shape of the SIM card 100 and the arrangement of the pads, the plurality of contacts 40 arranged in the second opening 36 lie under the incorrectly inserted SIM card 100. Thus, possible damage to the contacts 40 is prevented.

With the above-described SIM card rotated by $\theta_0$, a straight line (m) is drawn which passes through the base 42*b* of the left-handed elastic deformation portion 42 and parallel to the first sidewall 32. Then, clearly, the angle between the straight line (m) and the right side 102 of the SIM card is $\theta_0$. Again, as evident, the angle between the straight line (m) and the left-handed elastic deformation portion 42 of the SIM card is $\theta_1/2$. In this case, if $\theta_0 \leqq \theta_1/2$ (that is, $2\theta_0 \leqq \theta_1$) as shown in FIG. 4, the corner 101 of the SIM card 100 has not yet reached the contact portion 41 or left-handed elastic deformation portion 42 of the contact 40. In this state, further clockwise rotation of the SIM card 100 causes the right side 102 of the SIM card 100 to move from the base 42*b* of the left-handed elastic deformation portion 42, which is positioned almost flush with the top surface of the bottom wall 31, into contact with the contact portion 41. Thus, the right hand 102 of the SIM card 100 gradually elastically deforms and pushes the left-handed elastic deformation portion 42 downward, together with the contact portion 41, which is a free end. Consequently, the corner 101 of the SIM card 100 is prevented from coming into abutting contact with the left-handed elastic deformation portion 42 or the contact portion 41.

This means that setting the vertex angle $\theta_1$ such that $\theta_1 \geqq 2\theta_0$ prevents the corner portion 101 of the SIM card 100 from coming into abutting contact with the contact portion 41 or elastic deformation portion 42 of the contact. That is, it is understood that by setting the vertex angle $\theta_1$ of the inverted V-shaped or isosceles triangular contact 40 according to the invention as such, damage to contact 40 from buckling or twisting can be prevented.

The connector 10 according to the above-described first embodiment has the cover member 20 having sidewalls 22, 23, and 24 on the respective sides thereof, and the base member 30 including the sidewalls 32, 33, and 34 on the corresponding sides thereof as described above. However, the connector 10 according to the present invention is not limited in this aspect. FIG. 6 shows another embodiment of the connector.

Embodiment 2

The connector 110 shown in FIG. 6 has a structure in which the cover member 20 and the sidewalls 32, 33, and 34 of the base member 30 are omitted. Specifically, in the connector 110, the base member 130 includes only a bottom wall 131. The electronic apparatus in which the connector 110 is installed includes the top plate portion of the cover member 20 and the sidewall portion along which the SIM card 100 is guided. The first and second openings 35 and 36 formed in the bottom wall 131 and the contacts 40 arranged in the first and second openings 35 and 36 are the same as those in the above-described embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A card connector for long side insertion of a rectangular SIM card with a built-in integrated circuit, having a bottom wall of a base member that supports a plurality of cantilevered contacts, wherein the plurality of contacts are arranged to correspond to respective plural external contact points of the inserted SIM card with the built-in integrated circuit;

each of the contacts has a contact portion for contacting one of the external contact points of the SIM card with the built-in integrated circuit, two elastic deformation portions configured to enable the contact portion to be elastically displaced up and down, and a terminal portion a part of which is for fixation to the bottom wall and connection to an external contact point of the electronic apparatus in which the card connector is installed;

the two elastic deformation portions are connected to form a substantially isosceles triangle shape with a vertex angle $\theta_1$ at a vertex corresponding to the contact portion; and the plurality of contacts are arranged parallel to one another, each in an inverted V shape with respect to the card insertion direction.

2. A card connector as claimed in claim 1, wherein a first opening and a second opening are formed in the bottom wall, and a plurality of the contacts are arranged in each of the openings.

3. A card connector as claimed in claim 2, wherein the vertex angle $\theta_1$ of the plurality of contacts arranged in the first opening is different from the vertex angle $\theta_1$ of the plurality of contacts arranged in the second opening.

4. A card connector for long side insertion of a rectangular SIM card with a built-in integrated circuit, having a bottom wall of a base member that supports a plurality of cantilevered contacts, wherein the plurality of contacts are arranged to correspond to respective plural external contact points of the inserted SIM card with the built-in integrated circuit;

each of the contacts has a contact portion for contacting one of the external contact points of the SIM card, a substantially isosceles triangular shaped elastic deformation portion configured to enable the contact portion to be elastically displaced up and down, and a terminal portion a part of which is for fixation to the bottom wall and connection to an external contact point of an electronic apparatus in which the card connector is installed, the substantially isosceles triangle shaped elastic deformation portion has a vertex angle $\theta_1$ at a vertex corresponding to the contact portion, and the plurality of contacts are arranged parallel to one another, each in an inverted V shape with respect to the card insertion direction.

5. A card connector as claimed in claim 4, wherein a first opening and a second opening are formed in the bottom wall, and a plurality of the contacts are arranged in each of the openings.

6. A card connector as claimed in claim 5, wherein the vertex angle $\theta_1$ of the plurality of contacts arranged in the first opening is different from the vertex angle $\theta_1$ of the plurality of contacts arranged in the second opening.

* * * * *